US009935398B2

(12) United States Patent
Yokoyama

(10) Patent No.: US 9,935,398 B2
(45) Date of Patent: Apr. 3, 2018

(54) CONNECTOR

(71) Applicant: JAPAN AVIATION ELECTRONICS INDUSTRY, LIMITED, Shibuya-ku, Tokyo (JP)

(72) Inventor: Yohei Yokoyama, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 15/288,893

(22) Filed: Oct. 7, 2016

(65) Prior Publication Data

US 2017/0125944 A1 May 4, 2017

(30) Foreign Application Priority Data

Oct. 28, 2015 (JP) ..... 2015-212258

(51) Int. Cl.

| | |
|---|---|
| ***H01R 13/64*** | (2006.01) |
| ***H01R 13/631*** | (2006.01) |
| ***H01R 13/502*** | (2006.01) |
| ***H01R 24/60*** | (2011.01) |
| *H01R 107/00* | (2006.01) |

(52) U.S. Cl.

CPC ..... *H01R 13/631* (2013.01); *H01R 13/502* (2013.01); *H01R 24/60* (2013.01); *H01R 2107/00* (2013.01)

(58) Field of Classification Search

CPC ..... H01R 13/631; H01R 13/6594; H01R 13/502; H01R 24/60

See application file for complete search history.

(56) References Cited

U.S. PATENT DOCUMENTS 9,444,204 B2 9/2016 Yen et al.
D769,196 S * 10/2016 Yokoyama ..... D13/147

(Continued)

FOREIGN PATENT DOCUMENTS

CN 204144593 U 2/2015
CN 204243358 U 4/2015

(Continued)

OTHER PUBLICATIONS

Taiwanese Office Action (and English translation thereof) dated Jun. 2, 2017 issued in counterpart Taiwanese Application No. 105132334.

*Primary Examiner* — Abdullah Riyami
*Assistant Examiner* — Nader Alhawamdeh
(74) *Attorney, Agent, or Firm* — Holtz, Holtz & Volek PC

(57) ABSTRACT

A connector has a housing and an internal structural body. The housing has a receiving portion while the internal structural body has contacts. The housing has a second upper inner wall surface and a second lower inner wall surface which define a rear portion of the receiving portion. Each of the second upper inner wall surface and the second lower inner wall surface is formed with contact accommodation portions which individually accommodate the contacts. The contact accommodation portions are grooves extending in a mating direction and opening to a front portion of the receiving portion at least in part. Each of the contacts has a spring portion which is resiliently deformable and a contact point supported by the spring portion. The contact point is situated inside the rear portion when the connector is separated from the mating connector.

6 Claims, 8 Drawing Sheets

(56) References Cited

U.S. PATENT DOCUMENTS

| | | | | |
|---|---|---|---|---|
| 2016/0020569 | A1* | 1/2016 | Ju | H01R 24/78 439/607.01 |
| 2016/0056586 | A1 | 2/2016 | Guo et al. | |
| 2017/0054256 | A1* | 2/2017 | Yokoyama | H01R 13/648 |
| 2017/0085039 | A1* | 3/2017 | Yokoyama | H01R 13/648 |
| 2017/0093062 | A1* | 3/2017 | Yokoyama | H01R 12/7047 |
| 2017/0125944 | A1* | 5/2017 | Yokoyama | H01R 13/631 |

FOREIGN PATENT DOCUMENTS

| | | | | | |
|---|---|---|---|---|---|
| CN | 204361415 | U | | 5/2015 | |
| CN | 204391417 | U | * | 6/2015 | H01R 24/78 |
| CN | 204464604 | U | | 7/2015 | |
| CN | 204597044 | U | | 8/2015 | |
| CN | 204597045 | U | | 8/2015 | |
| JP | 10321275 | A | | 12/1998 | |
| TW | 493185 | U | | 1/2015 | |
| TW | M493181 | U | | 1/2015 | |
| TW | M493187 | U | | 1/2015 | |
| TW | M495640 | U | | 2/2015 | |
| TW | 496862 | U | | 3/2015 | |

* cited by examiner

CONNECTOR

CROSS REFERENCE TO RELATED APPLICATIONS

This application is based on and claims priority under 35 U.S.C. § 119 to Japanese Patent Application No. JP2015-212258 filed Oct. 28, 2015, the contents of which are incorporated herein in their entirety by reference.

BACKGROUND OF THE INVENTION

This invention relates to a connector which is mateable with a mating connector complying with a predetermined standard.

A connector of this type is disclosed in TW M493185U (Patent Document 1), for example.

As shown in FIG. 13, a connector 900 disclosed in Patent Document 1 has a housing 910, a plurality of ground springs 920 and a plurality of contacts 930. The housing 910 has a receiving portion 912 which receives a mating connector (not shown). The receiving portion 912 has a front portion 914 and a rear portion 916. The front portion 914 is defined by a first upper inner wall surface 942 and a first lower inner wall surface 944 of the housing 910 in an up-down direction (Z-direction) perpendicular to a mating direction (X-direction). The rear portion 916 is defined by a second upper inner wall surface 962 and a second lower inner wall surface 964 of the housing 910 in the up-down direction (Z-direction). The first upper inner wall surface 942 and the first lower inner wall surface 944 are formed with first accommodation portions 946 which accommodate ground springs 920. The second upper inner wall surface 962 and the second lower inner wall surface 964 are formed with second accommodation portions 966 which accommodate contacts 930. Between the first accommodation portion 946 and the second accommodation portion 966, guides 970 are provided to guide the mating connector (not shown) and protect ends of the contacts 930.

SUMMARY OF THE INVENTION

There is a demand for reducing force (insertion and removal force) of insertion and removal of the mating connector according to usage of the connector. However, when the insertion and removal force is reduced, a relative position of the mating connector with respect to the connector tends to deviate from a proper mating position. On the other hand, the connector disclosed in Patent Document 1 has a relatively short effective contact length of the contacts. Accordingly, bad connection is easy to occur in a case where the insertion and removal force of the connector disclosed in Patent Document 1 is reduced.

It is an object of the present invention to provide a connector which is connectable with a mating connector complying with a predetermined standard and in which an effective contact length of contacts is elongated.

One aspect of the present invention provides a connector which is mateable with a mating connector complying with a predetermined standard along a mating direction. The connector is provided with a housing and an internal structural body accommodated by the housing in part. The housing has an insertion opening and a receiving portion. The internal structural body has a plurality of contacts. Each of the contacts has a spring portion and a contact point supported by the spring portion. The spring portion is resiliently deformable. The receiving portion is to receive the mating connector in part through the insertion opening. The receiving portion has a front portion and a rear portion. The contact point is situated inside the rear portion when the connector is separated from the mating connector. The front portion is situated between the rear portion and the insertion opening in the mating direction. The front portion and the rear portion have axes coincide with each other in up-down direction perpendicular to the mating direction. The housing has a first upper inner wall surface, a first lower inner wall surface, a second upper inner wall surface and a second lower inner wall surface. The first upper inner wall surface and the first lower inner wall surface define the front portion in the up-down direction. The second upper inner wall surface and the second lower inner wall surface define the rear portion in the up-down direction. The first upper inner wall surface and the first lower inner wall surface have a first gap therebetween in the up-down direction. The second upper inner wall surface and the second lower inner wall surface have a second gap therebetween in the up-down direction. The first gap is larger than the second gap. Each of the second upper inner wall surface and the second lower inner wall surface is formed with a plurality of contact accommodation portions which accommodate the contacts, individually. Each of the contact accommodation portions is a groove extending along the mating direction. The groove opens to the front portion at least in part in the mating direction.

Accordingly to the aspect of the present invention, each of the contact accommodation portions (grooves), which accommodate the contacts, opens to the front portion of the receiving portion at least in part. Therefore, the contact point of the contact is allowed to be near the insertion opening. Thus, the effective contact length of the contacts can be longer.

An appreciation of the objectives of the present invention and a more complete understanding of its structure may be had by studying the following description of the preferred embodiment and by referring to the accompanying drawings.

Figure 1:
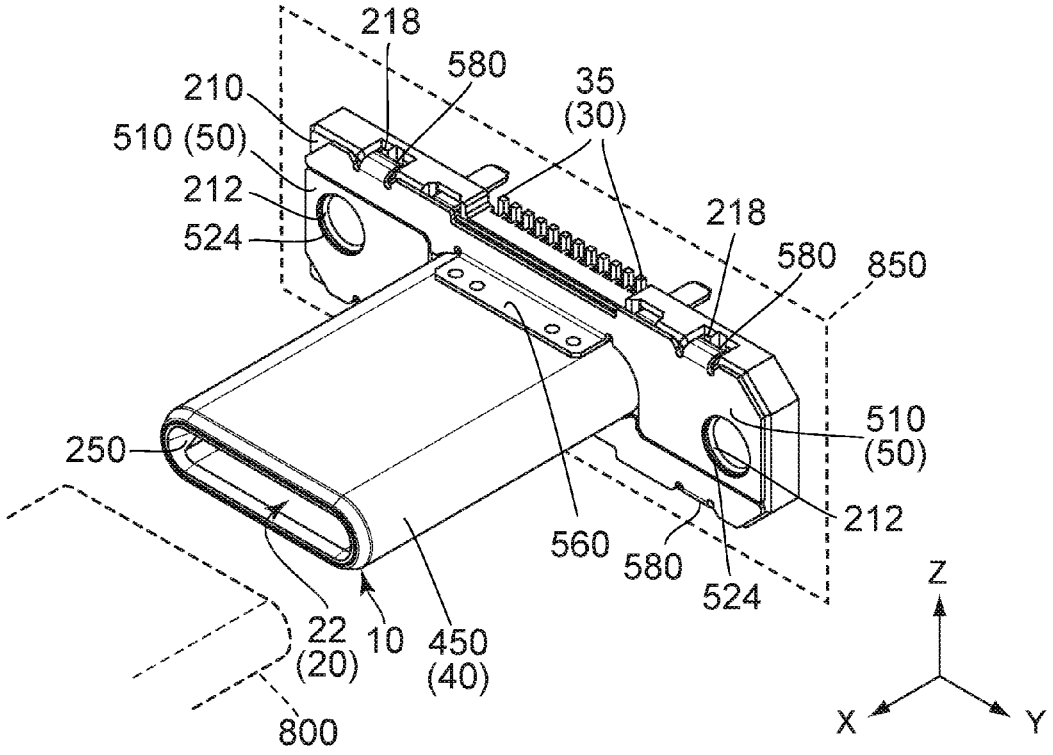
FIG. 1 is a perspective view showing a connector according to an embodiment of the present invention. A part of a mating connector and a part of a circuit substrate are depicted by broken lines.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 10 according to an embodiment of the present invention is used in a state that it is mounted on a circuit substrate 850 of a device (not shown), for example. In other words, the connector 10 is a board connector. The connector 10 is mateable with a mating connector 800 complying with a predetermined standard along a front-rear direction (a mating direction or an X-direction). The predetermined standard is, for example, Universal Serial Bus (USB) Type-C standard. In the present embodiment, the connector 10 is a plug connector complying with USB Type-C standard. However, the present invention is not limited thereto. The present invention is applicable to various connectors mateable with mating connectors complying with various standards.

Figure 2:
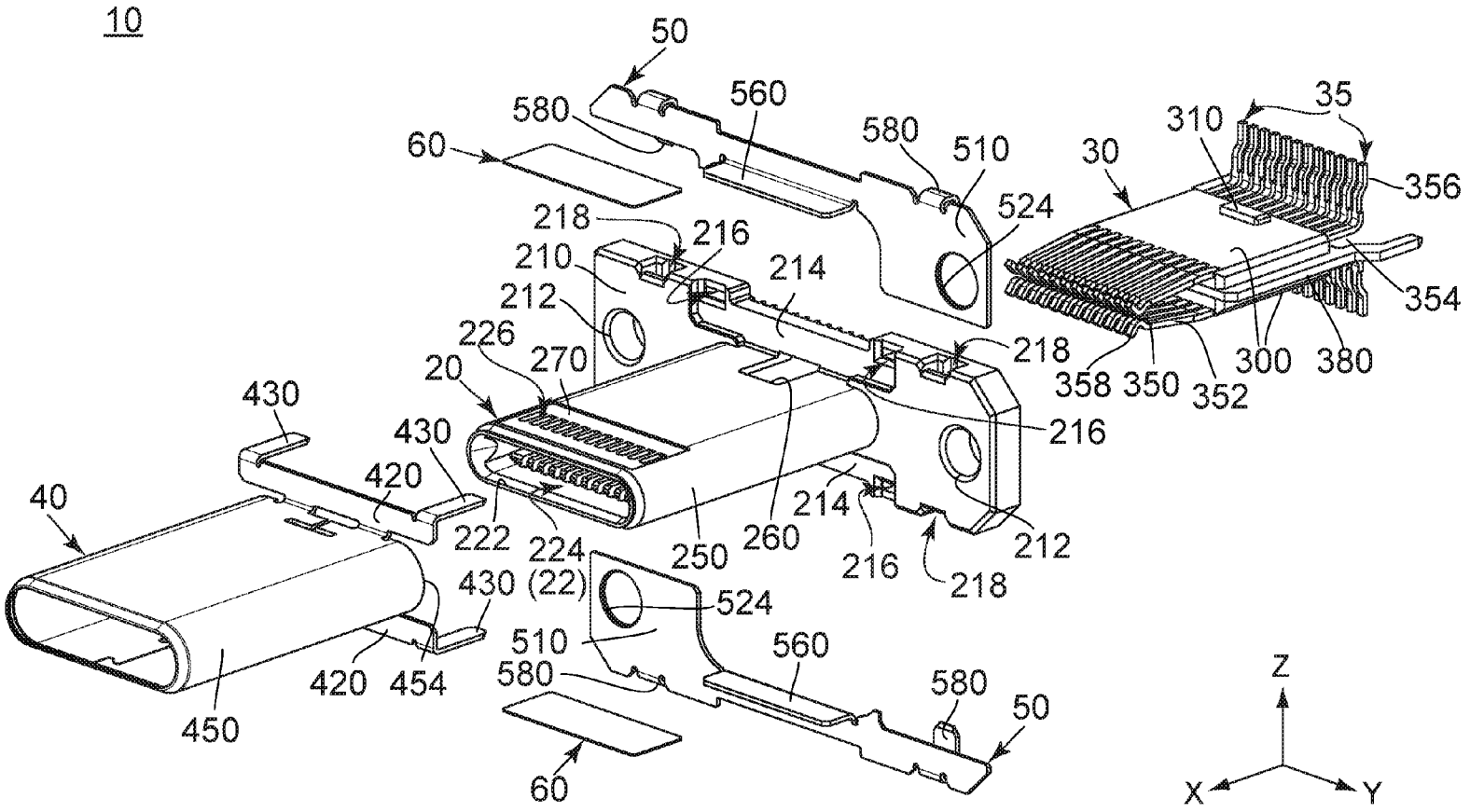
FIG. 2 is an exploded perspective view showing the connector of FIG. 1.

Referring to FIG. 2, the connector 10 is provided with a housing 20, an internal structural body 30, a shell 40, two additive members 50 and two insulating members 60. The housing 20 is made of insulator. The shell 40 is made of metal. The additive members 50 are also made of metal. The insulating members 60 are made of insulator. The internal structural body 30 includes two holding members 300, a plurality of contacts 35 and a ground plate 380. The holding members 300 are made of insulator. The contacts 35 are made of conductor. The ground plate 380 is also made of conductor.

Figure 3:
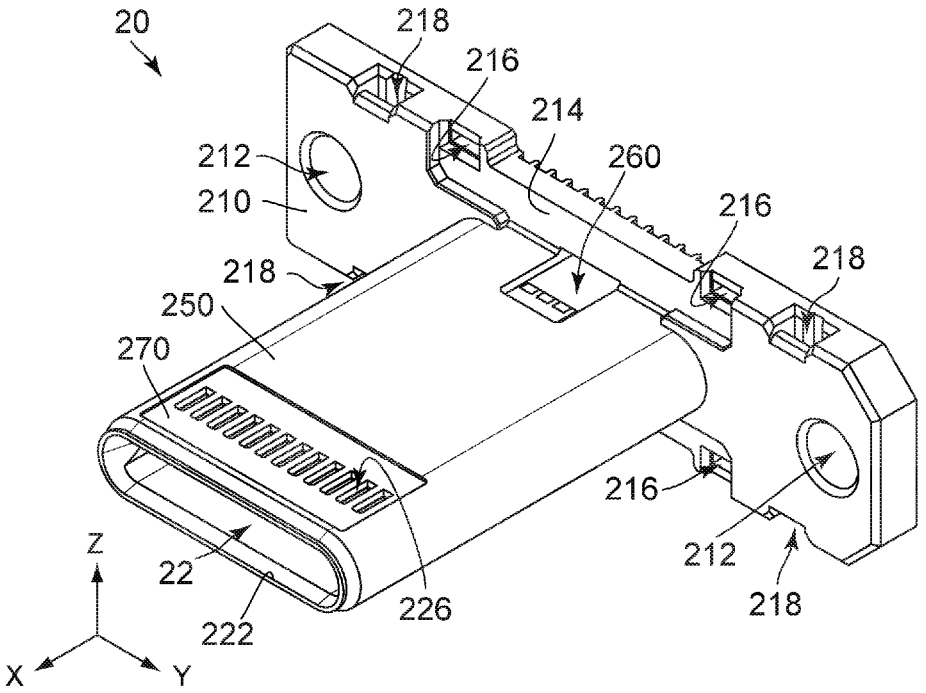
FIG. 3 is a perspective view of a housing included in the connector FIG. 2.

Referring to FIG. 3 in addition to FIG. 2, the housing 20 has a base portion 210 and a body portion 250. The base portion 210 has a flat plate shape parallel to a Y-Z plane. In detail, a cross-section of the base portion 210 on the Y-Z plane has a nearly rectangular shape which is long in a pitch direction (Y-direction) and short in an up-down direction (Z-direction). The base portion 210 is formed with two first screw holes 212, two hollow portions 214, four alignment holes (three of them are shown) 216 and four press-fit grooves 218. The body portion 250 extends forward (in a positive X-direction) from the base portion 210 along the front-rear direction (X-direction). Specifically, the body portion 250 has a flat cylindrical shape extending along the X-direction. In detail, a cross-section of the body portion 250 on the Y-Z plane has an ellipse shape (see FIG. 4) which is long in the pitch direction (Y-direction) and short in the up-down direction (Z-direction). The body portion 250 is formed with an opening portion 260 and a covered portion 270 on each of an upper surface (a surface toward a positive Z-direction) and a lower surface (a surface toward a negative Z-direction) thereof. Each of the opening portions 260 is a square hole which penetrates the body portion 250 in the up-down direction (Z-direction). Each of the covered portions 270 is a recess which is recessed toward an accommodation portion 22 in the up-down direction (Z-direction). In each of the covered portions 270, accepting portions 226 mentioned later are exposed.

As understood from FIGS. 2 and 3, the housing 20 has the accommodation portion 22. The accommodation portion 22 is a space which penetrates the base portion 210 and the body portion 250 in the front-rear direction (X-direction). In other words, the base portion 210 and the body portion 250 are formed with the accommodation portion 22. Each of the base portion 210 and the body portion 250 surround the accommodation portion 22 on the Y-Z plane. The accommodation portion 22 partly accommodates the internal structural body 30. In other words, a part of the internal structural body 30 is accommodated by the accommodation portion 22 of the housing 20.

As understood from FIG. 2, the internal structural body 30 has a structure which is mirror symmetric with respect to an X-Y plane. In detail, the ground plate 380 has a flat plate shape perpendicular to the up-down direction (Z-direction). Each of the holding members 300 has a flat plate shape perpendicular to the Z-direction if a protruding portion 310 protruding in the Z-direction is nothing. One of the holding members 300 is situated on the top of the ground plate 380 so that the protruding portion 310 protrudes upward. The other of the holding members 300 is situated on the bottom of the ground plate 380 so that the protruding portion 310 protrudes downward. The protruding portions 310 are situated in the opening portions 260 of the housing 20 under a state that the internal structural body 30 is accommodated by the accommodation portion 22 of the housing 20.

Figure 6:
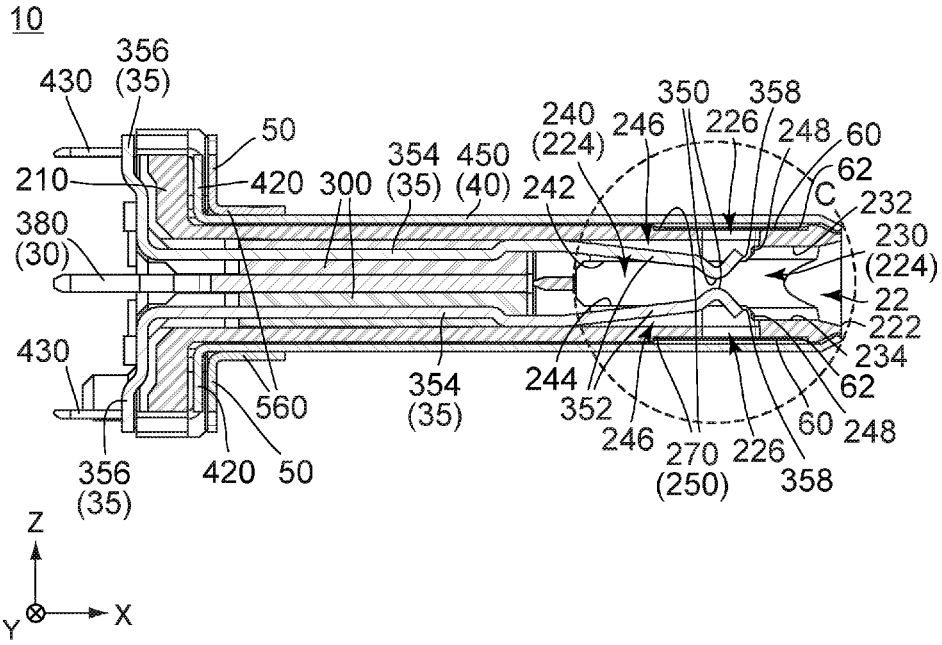
FIG. 6 is a cross-sectional view of the connector of FIG. 4, taken along B-B line.

Referring to FIG. 2, each of the holding members 300 holds the plurality of the contacts 35 aligned in the pitch direction (Y-direction). As shown in FIGS. 2 and 6, each of the contacts 35 has a contact portion (contact point) 350, a supporting portion (spring portion) 352, a held portion 354 and a fixed portion 356. The held portion 354 extends about linearly in the front-rear direction (X-direction). The held portion 354 is embedded in the holding member 300 in part by insert molding to be held by the holding member 300. The supporting portion 352 extends nearly forward (about in the positive X-direction) from the held portion 354. The supporting portion 352 is resiliently deformable at least in the up-down direction (Z-direction). The supporting portion 352 supports the contact portion 350 to allow the contact portion 350 to be moved at least in the up-down direction. In each of the contacts 35 held by the holding member 300 positioned upper, the contact portion 350 protrudes downward while the fixed portion 356 extends upward. In each of the contacts 35 held by the holding member 300 positioned lower, the contact portion 350 protrudes upward while the fixed portion 356 extends downward.

Referring to FIG. 2 again, the shell 40 is made of a single metal plate. The single metal plate is bent and both edges thereof are joined to each other at a lower side of the shell 40. In detail, the shell 40 has a cylindrical portion 450, three regulated portions 420 (two of them are shown) and four alignment portions 430 (three of them are shown). The cylindrical portion 450 has a flat cylindrical shape extending forward (in the positive X-direction) from a rear edge 454 thereof along the front-rear direction (X-direction). A cross-section of the cylindrical portion 450 on the Y-Z plane has an ellipse shape which is long in the pitch direction (Y-direction) and short in the up-down direction (Z-direction). In other words, the cylindrical portion 450 has a shape corresponding to the body portion 250 of the housing 20. The cylindrical portion 450 is formed with a joint of the metal plate on a lower surface thereof. One of the regulated portions 420 is situated at the rear edge 454 and connected to an upper surface of the cylindrical portion 450 to extend upward (in the positive Z-direction). The remaining two of the regulated portions 420 are situated at the rear edge 454 and connected to the lower surface of the cylindrical portion 450 to extend downward (in the negative Z-direction). Two of the alignment portions 430 extend rearward (in a negative X-direction) from both ends, in pitch direction (Y-direction), of the regulated portion 420 positioned upper. The remaining two of the alignment portions 430 extend rearward (in the negative X-direction) from outside ends, in the pitch direction (Y-direction), of the two regulated portions 420 positioned lower. In detail, one of the remaining two of the alignment portions 430 extends from the end, in the positive Y-direction, of the regulated portion 420 positioned lower in the positive Y-direction. The other of the remaining two of the alignment portions 430 extends from the end, in a negative Y-direction, of the regulated portion 420 positioned lower in the negative Y-direction. Under a state that the shell 40 is attached to the housing 20, the regulated portions 420 are accommodated by the hollow portions 214 of the housing 20 while the alignment portions 430 are inserted into the alignment holes 216 of the housing 20.

As understood from FIG. 2, the two additive members 50 have a shape same as each other. In other words, the two additive members 50 are parts same as each other. The two additive members 50, however, are different from each other in arrangement in the connector 10. Specifically, the additive members 50 are arranged at positions which are rotation symmetry with respect to an axis parallel to the front-rear direction (X-direction).

Figure 4:
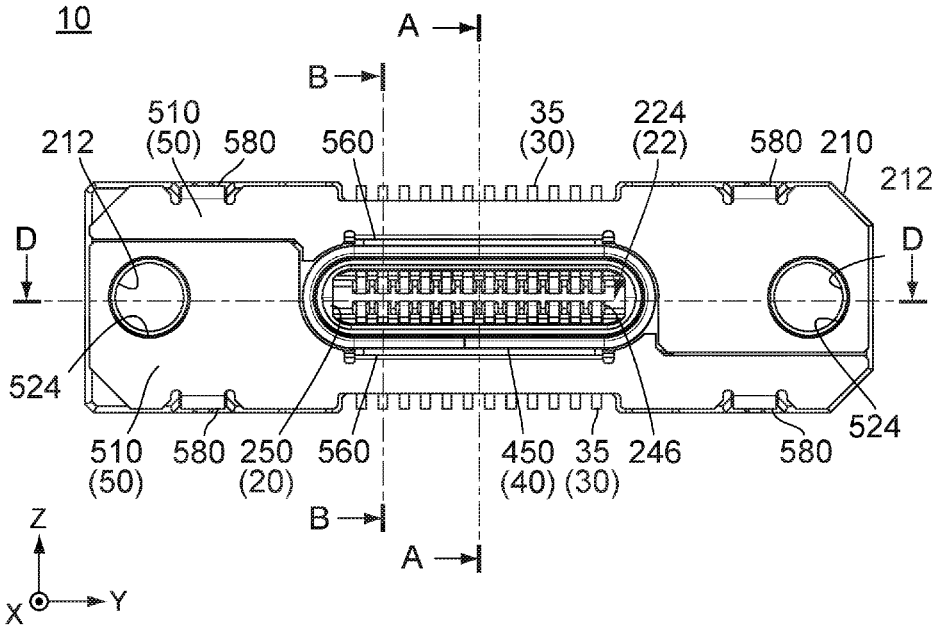
FIG. 4 is a front view of the connector of FIG. 1.

Referring to FIG. 4 in addition to FIG. 2, each of the additive members 50 has a main portion 510 and a connecting portion 560. Each of the additive members 50 is made by bending a single metal plate. The main portion 510 is a flat plate perpendicular to the front-rear direction (X-direction). The connecting portion 560 extends forward (in the positive X-direction) from an edge of the main portion 510. The main portion 510 is formed with a second screw hole 524 and a pair of press-fitted portions 580. The second screw hole 524 penetrates the additive member 50. The second screw hole 524 is used to fix the connector 10 on the circuit substrate 850 (see FIG. 1) using a screw (not shown) together with the first screw hole 212. The press-fitted portions 580 are provided at vicinities of both ends, in the pitch direction (Y-direction), of the main portion 510 and extend rearward (in the negative X-direction) and then extend inward in the up-down direction (Z-direction). In detail, the press-fitted portions 580 of the additive member 50 positioned lower extend rearward (in the negative X-direction) and then extend upward (in the positive Z-direction). On the other hand, the press-fitted portions 580 of the additive member 50 positioned upper extend rearward (in the negative X-direction) and then extend downward (in the negative Z-direction). Under a state that the additive member 50 is attached to the housing 20 together with the shell 40, the press-fitted portions 580 are press-fit into the press-fit grooves 218 of the housing 20. Furthermore, the main portions 510 cover the regulated portions 420 accommodated in the hollow portions 214 of the housing 20. The connecting portions 560 are connected to and fixed to the shell 40.

Referring to FIG. 2, each of the insulating members 60 according to the present embodiment is an insulating tape having a rectangular shape. The present embodiment employs a polyimide film as the insulating tape. The insulating members 60 are arranged in the covered portions 270 of the housing 20. In other words, the insulating members 60 are arranged between the housing 20 and the shell 40. However, the insulating members 60 may have any shape and be made of any material provided that they have enough insulation property. Moreover, the insulating members 60 may be provided according necessary.

Figure 5:
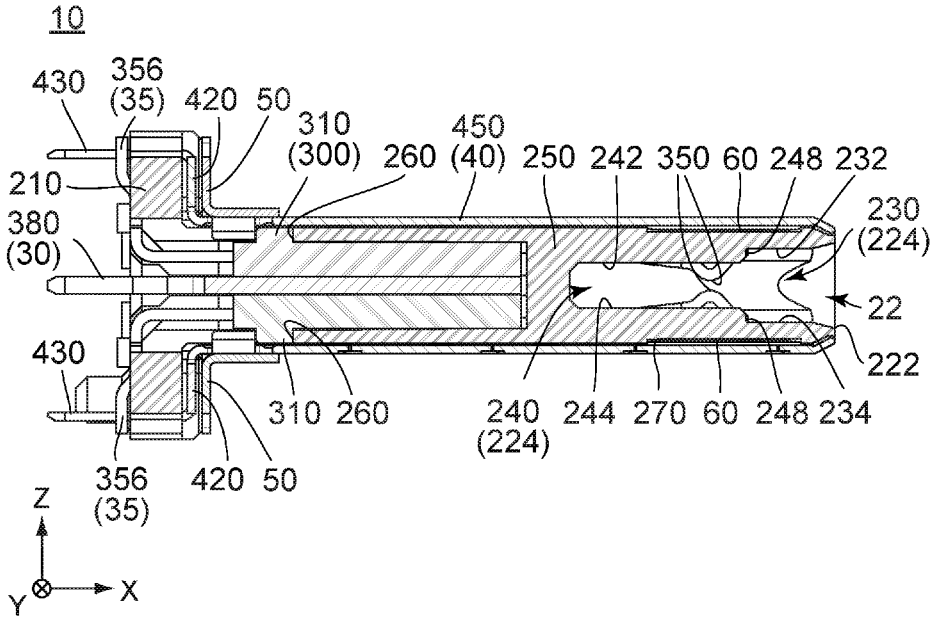
FIG. 5 is a cross-sectional view of the connector of FIG. 4, taken along A-A line.
Figure 7:
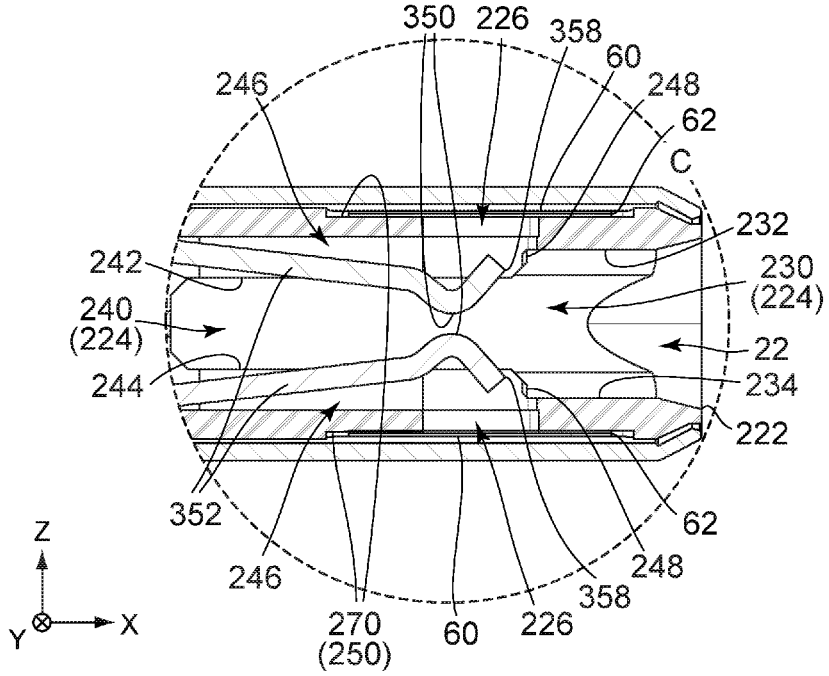
FIG. 7 is an enlarged cross-sectional view showing a part (surrounded by a broken line C) of the connector of FIG. 6.
Figure 8:
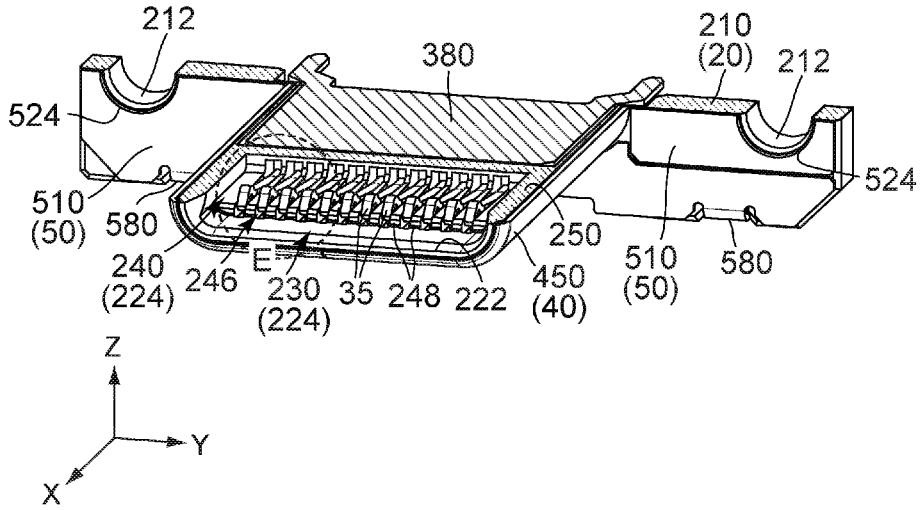
FIG. 8 is a perspective cross-sectional view of the connector of FIG. 4, taken along D-D line.
Figure 9:
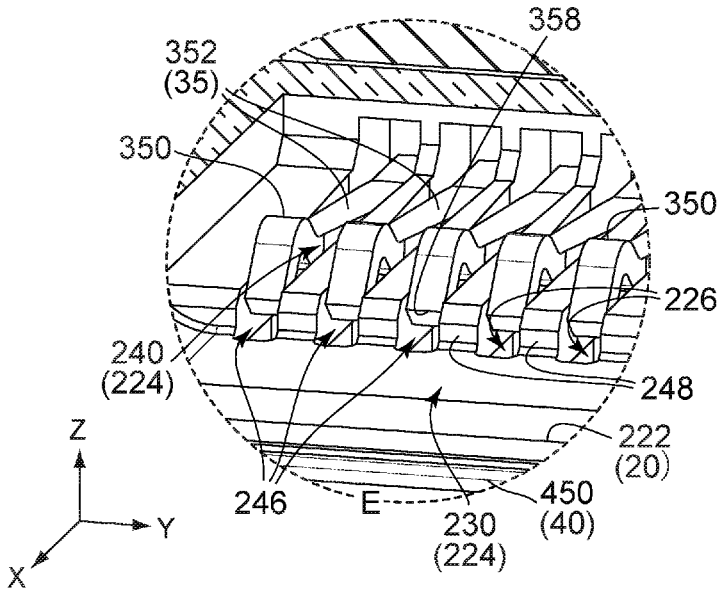
FIG. 9 is an enlarged view showing a part (surrounded by a broken line E) of the connector of FIG. 8.

Referring to FIGS. 5 to 7, the housing 20 has an insertion opening 222, a receiving portion 224 and a plurality of accepting portions 226. The insertion opening 222 is an end portion of a front part (at a positive X-direction side) of the accommodation portion 22. The receiving portion 224 is a part of the accommodation portion 22. The accepting portions 226 are holes which penetrate the housing 20 in the up-down direction. The receiving portion 224 is a space for receiving a part of the mating connector 800 (see FIG. 8) through the insertion opening 222. The receiving portion 224 has a front portion 230 and a rear portion 240. The front portion 230 is situated rearward (at a negative X-direction side) of the insertion opening 222 in the front-rear direction while the rear portion 240 is situated rearward (at a negative X-direction side) of the front portion 230 in the front-rear direction. Thus, the front portion 230 is situated between the insertion opening 222 and the rear portion 240 in the front-rear direction (X-direction).

As understood from FIG. 4, the receiving portion 224 (connector 10) is designed for so called reversible insertion. Assuming a virtual central axis extending in the front-rear direction (X-direction), the receiving portion 224 has a shape which is rotation symmetry with respect to the virtual central axis. In addition, as understood from FIGS. 5 to 7, the front portion 230 and the rear portion 240 have axes which are coincide with each other in the up-down direction (Z-direction). The front portion 230 is defined by a first upper inner wall surface 232 and a first lower inner wall surface 234 in the up-down direction. On the other hand, the rear portion 240 is defined by a second upper inner wall surface 242 and a second lower inner wall surface 244 in the up-down direction. In other words, the housing 20 has the first upper inner wall surface 232 and the first lower inner wall surface 234 which define the front portion 230. The housing 20 further has the second upper inner wall surface 242 and the second lower inner wall surface 244 which define the rear portion 240. The front portion 230 is larger than the rear portion 240 in the up-down direction. In detail, a first gap between the first upper inner wall surface 232 and the first lower inner wall surface 234 is larger than a second gap between the second upper inner wall surface 242 and the second lower inner wall surface 244. A cross section area of the front portion 230 on the Y-Z plane gradually increases toward the insertion opening 222 in a vicinity of the insertion opening 222.

As understood from FIGS. 4 and 6 to 9, each of the second upper inner wall surface 242 and the second lower inner wall surface 244 is formed with a plurality of contact accommodation portions 246 which individually accommodate the contacts 35. In detail, the contact accommodation portions 246 are grooves formed in the housing 20 along the front-rear direction (X-direction). The contact accommodation portions 246 open to the front portion 230 of the receiving portion 224 at least in part. In other words, the contact accommodation portions (grooves) 246 communicate with the front portion 230 of the receiving portion 224. The contact accommodation portions 246 have a size which allows the supporting portion 352 of the contact 35 to be resiliently deformed.

As understood from FIGS. 6 and 7, the accepting portions 226 correspond to the contact accommodation portions 246, respectively. In detail, the accepting portions 226 are situated outside the contact accommodation portions 246 without overlapping with the receiving portion 224 in the up-down direction. In other words, the contact accommodation portions 246 are situated between the accepting portions 226 in the up-down direction. Furthermore, the accepting portions 226 overlap with the contact accommodation portions 246 (or the rear portion 240 of the receiving portion 224). In the present embodiment, front ends of the front-rear direction (X-direction) of the accepting portions 226 are situated forward (beyond the positive X-direction side) of front end surfaces 248 of wall portions defining the contact accommodation portions 246. In other words, the accepting portions 226 overlap with the front portion 230 of the receiving portion 224 in the front-rear direction. However, it is desirable that the overlapping is smaller. This is for avoiding deterioration of strength of the housing 20. One of ends of the accepting portion 226 continues to the contact accommodation portion 246 in the up-down direction (Z-direction) while the other end is exposed in the covered portion 270. The insulating member 60 is arranged in the covered portion 270. The other end of the accepting portion 226 is covered by the insulating member 60. In other words, the insulating member 60 is arranged outside the accepting portions 226 without overlapping with both of the receiving portion 224 and the contact accommodation portions 246 in the up-down direction. That is, the accepting portions 226 are situated between the insulating members 60 in the up-down direction. The insulating members 60 are in contact with the housing 20 to straddle each of the accepting portions 226 in front-rear direction (X-direction) and the pitch direction (Y-direction). In other words, the insulating members 60 extend forward (in the positive X-direction) and rearward (in the negative X-direction) beyond the accepting portions 226 in the front-rear direction (X-direction). Furthermore, the insulating members 60 cover two or more of the accepting portions 226 in the pitch direction (Y-direction). The insulating members 60 of the present embodiment have a size twice or more than a size of the accepting portion 226 in the front-rear direction (X-direction). Front edges 62 (edges in the positive X-direction) of the insulating members 60 reach vicinities of middle points between the accepting portions 226 and the insertion opening 222. Thus, the insulating members 60 extend toward the insertion opening 222 beyond the accepting portions 226 in the present embodiment. This can be achieved since the connector 10 has no ground springs (cf. 920 in FIG. 13). In the present embodiment, adhesive areas between the insulating members 60 and the housing 20 can be enlarged. Accordingly, the insulating members 60 can be firmly fixed to the housing 20. The insulating members 60 prevent tips 358 or their peripheries of the contact 35 from being brought into contact with the shell 40. The accepting portions 226 function to expand movable ranges of the contact portions 350 of the contacts 35 without magnification of a size of the housing 20 in the up-down direction. In other words, the accepting portions 226 are useful for securing the movable ranges necessary for the contact portions 350 of the contacts 35 and for reducing the size of the housing 20 in the up-down direction. On the other hand, the insulating members 60 maintain electric insulation between the contacts 35 and the shell 40. In a case where a size of the connector 10 is not limited, the accepting portions 226 are not always necessary. In such a case, the insulating members 60 are also unnecessary.

As shown in FIGS. 6 and 7, the contact accommodation portion (groove) 246 accommodates a part of the supporting portion 352 of the contact 35 when the connector 10 is separated from the mating connector 800 (see FIG. 1). Simultaneously, the contact accommodation portion 246 also accommodates the tip 358 of the contact 35. At this time, the contact portion 350 of the contact 35 is situated outside the contact accommodation portion (groove) 246. That is, the contact portion 350 is situated inside the rear portion 240 of the receiving portion 224. A position of the tip 358 of the contact 35 overlaps with the accepting portion 226 in the front-rear direction (X-direction). Furthermore, the tip 358 of the contact 35 is situated between the accepting portions 226 in the up-down direction (Z-direction). In other words, each of the tips 358 of the contacts 35 are situated rearward (beyond the negative X-direction side) of the front end surface 248 in the front-rear direction (Z-direction) and outward of the second upper inner wall surface 242 and the second lower inner wall surface 244 in the up-down direction (Z-direction). In detail, the tips 358 of the contacts 35 positioned upper are situated upward (beyond the positive Z-direction side) of the second upper inner wall surface 242 in the up-down direction (Z-direction) while the tips 358 of the contacts 35 positioned lower are situated downward (beyond the negative Z-direction side) of the second lower inner wall surface 244. In the present embodiment, the tips 358 of the contacts 35 are situated downward (beyond the negative Z-direction side) of the first upper inner wall surface 232 and upward (beyond the positive Z-direction side) of the first lower inner wall surface 234 in the up-down direction (Z-direction). Accordingly, as understood from FIGS. 8 and 9, the tips 358 of the contacts 35 can be seen when the inside of the connector 10 is seen through the insertion opening 222. The tips 358 of the contacts 35 may be situated inside the accepting portions 226. However, in such a case, a movable range of the tips 358 is reduced in the up-down direction (Z-direction).

Figure 11:
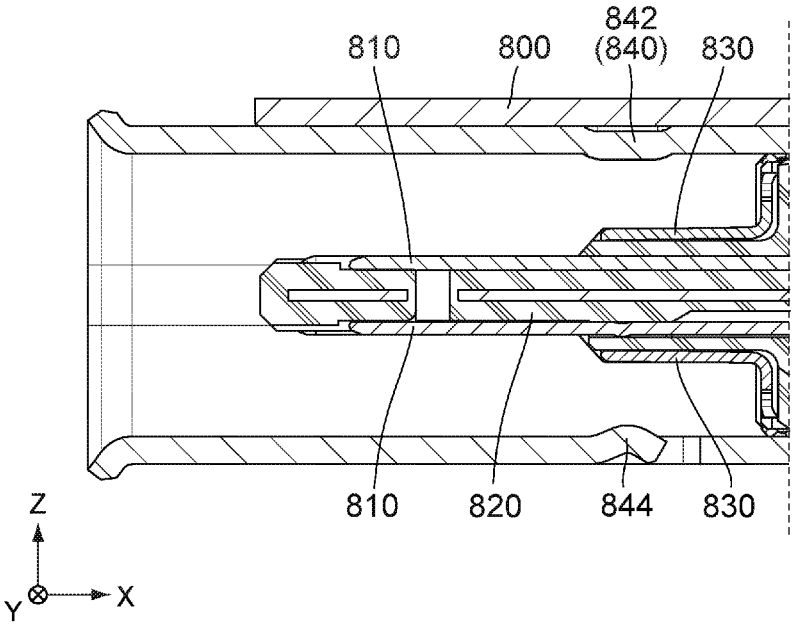
FIG. 11 is a sectional view of the part of the mating connector of FIG. 10.

Referring to FIG. 11, the mating connector 800 has a plurality of mating contacts 810, a mating holding member 820 holding the mating contacts 810, ground plates 830 and a mating shell 840. The mating shell 840 accommodates the mating holding member 820 with the mating contacts 810 and the ground plates 830 therein. In the present embodiment, the mating connector 800 is a receptacle connector complying with USB Type-C standard.

Figure 10:
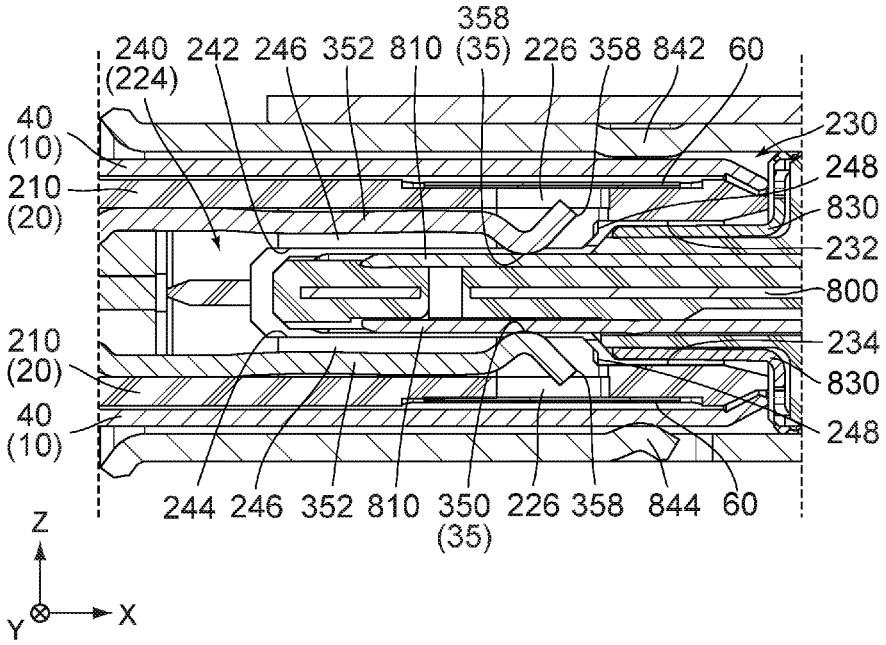
FIG. 10 is a cross-sectional view showing a part of the connector of FIG. 6 and a part of the mating connector. The connector and the mating connector are in a mated state.

As understood from FIGS. 10 and 11, when the mating connector 800 is received by the receiving portion 224, the contact portions 350 situated inside the rear portion 240 of the receiving portion 224 are brought into contact with the mating contacts 810 of the mating connector 800. The supporting portions 352 are resiliently deformed according to insertion of the mating connector 800 into the connector 10. Then the supporting portions 352 press the contact portions 350 against the mating contacts 810 by reaction force thereof. Consequently, the contacts 35 are electrically and certainly connected to the mating contacts 810. On the other hand, when the mating connector 800 is inserted into the connector 10, the tips 358 of the contacts 35 are situated in the contact accommodation portions 246. Accordingly, the tips 358 cannot abut against the mating connector 800 inserted into the connector 10. Thus, the contacts 35 are prevented from buckling. Between the front end surfaces 248 of the wall portions defining the contact accommodation portion 246 and second upper inner wall surface 242 or the second lower inner wall surface 244, taper surfaces are formed. Accordingly, the mating connector 800 can be smoothly received.

Figure 13:
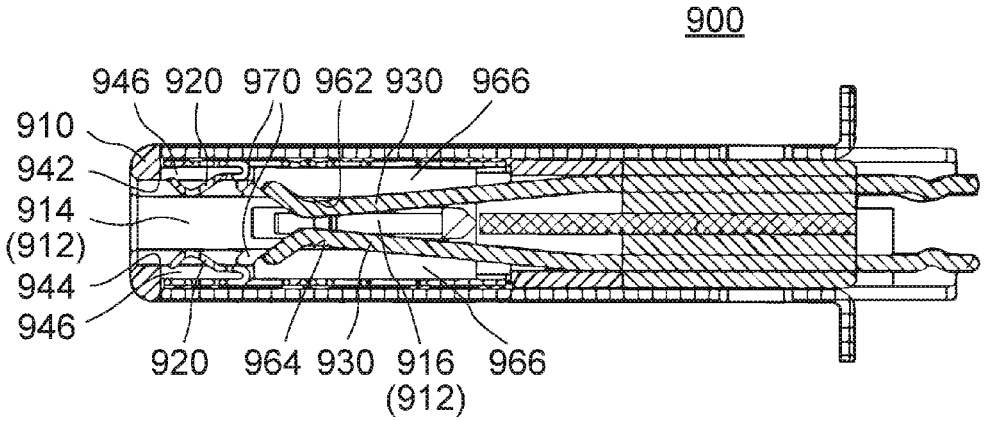
FIG. 13 PRIOR ART
FIG. 13 is a cross-sectional view showing the connector of Patent Document 1.
Figure 13:
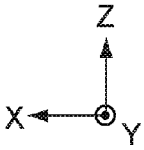
FIG. 13 PRIOR ART

Referring to FIGS. 5 to 10, the connector 10 of the present embodiment has no ground springs (cf. 920 in FIG. 13). In addition, as mentioned above, the contact accommodation portion 246 communicates with the front portion 230 of the receiving portion 224 at least in part in the connector 10 of the present embodiment. Accordingly, the contacts 35 can have a length longer than that of the connector 900 of FIG. 13 in the front-rear direction (X-direction). As understood from FIGS. 10 and 11, the length of the contacts 35, however, are limited by existence of the ground plates 830 of the mating connector 800. In other words, the length of the contacts 35 is limited not to reach the ground plates 830 under the state that the connector 10 is mated with the mating connector 800.

Figure 12:
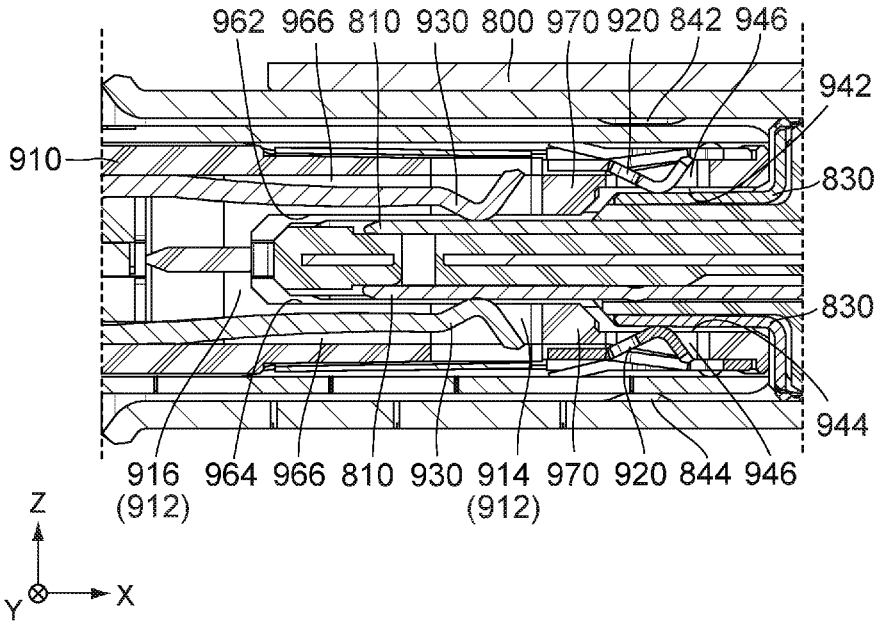
FIG. 12 is a cross-sectional view showing a part of a connector (comparative connector) having a structure similar to that of a connector of Patent Document 1 and the part of the mating connector of FIG. 11. The comparative connector and the mating connector are in a mated state.

As understood by comparing FIG. 10 with FIG. 12, when the length of the contacts 35 is longer, an effective contact length of the contacts 35 for the mating contacts 810 is longer. The effective contact length is a distance that the contact portion 350 can be in contact with and moved on the mating contact 810 when the connector 10 is mated with the mating connector 800.

According to the present embodiment, the effective contact length of the contacts 35 is longer. Thus, the contacts 35 and the mating contacts 810 are maintained in a contact state that they are contact with each other even if the mating connector 800 is shifted from a correct mating position with respect to the connector 10. In other words, the contacts 35 and the mating contacts 810 are surely and electrically connected to each other. Accordingly, the connector 10 can be connected to the mating connector 800 with high stability and reliability even if the connector 10 is designed and manufactured to reduce forces necessary for insertion and removal of the mating connector 800.

Referring to FIG. 11 again, the mating shell 840 of the mating connector 800 has a protrusion 842 and a pressure foot portion 844. This is for making secure electrical connection between the shell 40 of the connector 10 and the mating shell 840 of the mating connector 800. In addition, this is for adjusting the forces necessary to insert or remove the mating connector 800 into or from the connector 10 by means of the protrusion 842 and the pressure foot portion 844. In the present embodiment, the protrusion 842 and the pressure foot portion 844 face each other in the up-down direction. However, the protrusion 842 and the pressure foot portion 844 may deviate from each other. Furthermore, one of the protrusion 842 and the pressure foot portion 844 may be provided, and the other may be eliminated. Alternatively, a part or parts corresponding one or both of the protrusion 842 and the pressure foot portion 844 may be provided on the shell 40 of the connector 10.

Although the specific explanation about the present invention is made above referring to the embodiments, the present invention is not limited thereto. The present invention is susceptible to various modifications and alternative forms.

For example, the front end surfaces 248 of the wall portions defining the contact accommodation portions 246 may be inclined to the Y-Z plane though the front end surfaces 248 are parallel to the Y-Z plane in the present embodiment. Alternatively, the front end surfaces 248 may be curved surfaces which smoothly continue to the second upper inner wall surface 242 and the second lower inner wall surface 244.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector mateable with a mating connector which complies with a predetermined standard along a mating direction, wherein:

the connector is provided with a housing and an internal structural body accommodated by the housing in part;

the housing has an insertion opening and a receiving portion;

the internal structural body has a plurality of contacts;

each of the contacts has a spring portion and a contact point supported by the spring portion;

the spring portion is resiliently deformable;

the receiving portion is configured to receive the mating connector in part through the insertion opening;

the receiving portion has a front portion and a rear portion;

the contact point is situated inside the rear portion when the connector is separated from the mating connector;

the front portion is situated between the rear portion and the insertion opening in the mating direction;

the front portion and the rear portion have axes which coincide with each other in an up-down direction perpendicular to the mating direction;

the housing has a first upper inner wall surface, a first lower inner wall surface, a second upper inner wall surface, and a second lower inner wall surface;

the first upper inner wall surface and the first lower inner wall surface define the front portion in the up-down direction;

the second upper inner wall surface and the second lower inner wall surface define the rear portion in the up-down direction;

the first upper inner wall surface and the first lower inner wall surface have a first gap therebetween in the up-down direction;

the second upper inner wall surface and the second lower inner wall surface have a second gap therebetween in the up-down direction;

the first gap is larger than the second gap;

each of the second upper inner wall surface and the second lower inner wall surface is formed with a plurality of contact accommodation portions which accommodate the contacts, individually;

each of the contact accommodation portions is a groove extending along the mating direction;

each of the contacts has a tip; and the groove opens to the front portion at least in part in the mating direction so that the tip is visible through the insertion opening when viewed along the mating direction.

2. The connector as recited in claim 1, wherein the tip is situated inside the groove.

3. The connector as recited in claim 2, wherein the tip is situated below the first upper inner wall surface and above the first lower inner wall surface in the up-down direction.

4. The connector as recited in claim 2, wherein:

the connector further comprises a pair of insulating members;

the housing further has a plurality of accepting portions;

the accepting portions correspond to the contact accommodation portions, respectively, and are situated outside the contact accommodation portions without overlapping with the receiving portion in the up-down direction;

each of the accepting portions is a hole which penetrates the housing in the up-down direction to continue to the contact accommodation portion corresponding thereto;

the accepting portion allows the tip to be moved by resilient deforming of the spring portion;

the insulating members are situated outward of the accepting portions without overlapping with both of the receiving portion and the contact accommodation portions in the up-down direction; and the insulating members are in contact with the housing to straddle the accepting portions.

5. The connector as recited in claim 4, wherein the insulating members cover the accepting portions and extend toward the insertion opening beyond the accepting portions in the mating direction.

6. The connector as recited in claim 4, wherein each of the insulating members is arranged to cover two or more of the accepting portions in a pitch-direction perpendicular to both of the mating direction and the up-down direction.

* * * * *